US011104146B2

(12) United States Patent
Kanegae et al.

(10) Patent No.: US 11,104,146 B2
(45) Date of Patent: Aug. 31, 2021

(54) LIQUID EJECTING HEAD AND LIQUID EJECTING APPARATUS

(71) Applicant: SEIKO EPSON CORPORATION, Tokyo (JP)

(72) Inventors: Takahiro Kanegae, Shiojiri (JP); Katsuhiro Okubo, Azumino (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/728,873

(22) Filed: Dec. 27, 2019

(65) Prior Publication Data

US 2020/0207109 A1 Jul. 2, 2020

(30) Foreign Application Priority Data

Dec. 28, 2018 (JP) ..... JP2018-248168

(51) Int. Cl.
*B41J 2/175* (2006.01)

(52) U.S. Cl.
CPC ..... *B41J 2/17563* (2013.01)

(58) Field of Classification Search
CPC . B41J 2/17563; B41J 2/18; B41J 2/175; B41J 2/14
USPC ..... 347/93
See application file for complete search history.

(56) References Cited

U.S. PATENT DOCUMENTS 6,000,792 A 12/1999 Koizumi et al.
6,019,465 A * 2/2000 Shinada ..... B41J 2/17513 347/93
6,626,522 B2 * 9/2003 Rapp ..... B41J 2/1404 347/65
8,267,504 B2 * 9/2012 Baumer ..... B41J 2/03 347/63
9,914,308 B2 3/2018 Yamada et al.
2011/0242237 A1 * 10/2011 Uezawa ..... B41J 2/18 347/89
2014/0104348 A1 4/2014 Owaki et al.
(Continued)

FOREIGN PATENT DOCUMENTS

EP 0585901 3/1994
JP 2011-194575 10/2011
JP 2014-172324 9/2014

*Primary Examiner* — Huan H Tran
*Assistant Examiner* — Alexander D Shenderov
(74) *Attorney, Agent, or Firm* — Workman Nydegger

(57) ABSTRACT

A liquid ejecting head including a first-liquid ejecting portion, a second-liquid ejecting portion, a common supply flow path being supplied a liquid from a liquid reservoir, a first-individual supply flow path communicating the common supply flow path and the first-liquid ejecting portion to each other, a second-individual supply flow path communicating the common supply flow path and the second-liquid ejecting portion to each other, a first-filter provided in the first-individual supply flow path, and a second-filter provided in the second-individual supply flow path. In the liquid ejecting head, regarding flow path resistance in the first-individual supply flow path, flow path resistance in the first-filter is the largest, regarding flow path resistance in the second-individual supply flow path, flow path resistance in the second-filter is the largest, and the flow path resistance in the first-filter and the flow path resistance in the second-filter are the same.

18 Claims, 5 Drawing Sheets

(56) References Cited

U.S. PATENT DOCUMENTS

| | | | | |
|---|---|---|---|---|
| 2015/0085021 | A1* | 3/2015 | Govyadinov | B05C 5/02 347/63 |
| 2017/0217198 | A1 | 8/2017 | Sato et al. | |

* cited by examiner

LIQUID EJECTING HEAD AND LIQUID EJECTING APPARATUS

The present application is based on, and claims priority from JP Application Serial Number 2018-248168, filed Dec. 28, 2018, the disclosure of which is hereby incorporated by reference herein in its entirety.

BACKGROUND

1. Technical Field

The present disclosure relates to a liquid ejecting head and a liquid ejecting apparatus.

2. Related Art

Hitherto, a technique for ejecting a liquid, such as ink, from nozzles has been proposed. For example, JP-A-2014-172324 discloses a configuration in which a liquid is circulated between a liquid container that stores the liquid and a liquid ejecting portion that ejects the liquid from nozzles.

A configuration in which a liquid stored in a liquid container is supplied to a plurality of liquid ejecting portions is assumed. In such a configuration, a common supply flow path in communication with the liquid container, and individual supply flow paths, each for a liquid ejecting portion, that communicate the common supply flow path and the liquid ejecting portions to each other are installed between the liquid container and each liquid ejecting portion. In a configuration in which a filter that captures foreign matters or air bubbles mixed in the liquid is installed in the common supply flow path, a large filter needs to be installed to obtain a sufficient amount of liquid supplied to the plurality of liquid ejecting portions. Furthermore, in a state in which flow path resistance in each individual supply flow path is different due to, for example, the air bubbles and the like, the amount of liquid supplied from the common supply flow path to the liquid ejecting portions through the individual supply flow paths may differ in each of the liquid ejecting portions.

SUMMARY

In order to overcome the above issue, a liquid ejecting head according to a desirable aspect of the present disclosure includes a first liquid ejecting portion that ejects a liquid, a second liquid ejecting portion that ejects the liquid, a common supply flow path to which the liquid from the liquid reservoir is supplied, a first individual supply flow path that communicates the common supply flow path and the first liquid ejecting portion to each other, a second individual supply flow path that communicates the common supply flow path and the second liquid ejecting portion to each other, a first filter installed in the first individual supply flow path, and a second filter installed in the second individual supply flow path. In the liquid ejecting head, regarding flow path resistance in the first individual supply flow path, flow path resistance in the first filter is the largest, regarding flow path resistance in the second individual supply flow path, flow path resistance in the second filter is the largest, and the flow path resistance in the first filter and the flow path resistance in the second filter are the same.

A liquid ejecting head according to a desirable aspect of the present disclosure includes a first liquid ejecting portion that ejects a liquid, a second liquid ejecting portion that ejects the liquid, a common supply flow path to which the liquid from a liquid reservoir is supplied, a first individual supply flow path that communicates the common supply flow path and the first liquid ejecting portion to each other, a second individual supply flow path that communicates the common supply flow path and the second liquid ejecting portion to each other, a first filter installed in the first individual supply flow path, and a second filter installed in the second individual supply flow path. In the liquid ejecting head, among pressure losses in the first individual supply flow path, a pressure loss in the first filter is the largest, among pressure losses in the second individual supply flow path, a pressure loss in the second filter is the largest, and the pressure loss in the first filter and the pressure loss in the second filter are the same.

A liquid ejecting apparatus according to a desirable aspect of the present disclosure includes a liquid ejecting head that ejects a liquid, and a controller that controls an ejection of liquid performed with the liquid ejecting head, in which the liquid ejecting head includes a first liquid ejecting portion that ejects a liquid, a second liquid ejecting portion that ejects the liquid, a common supply flow path to which the liquid from a liquid reservoir is supplied, a first individual supply flow path that communicates the common supply flow path and the first liquid ejecting portion to each other, a second individual supply flow path that communicates the common supply flow path and the second liquid ejecting portion to each other, a first filter installed in the first individual supply flow path, and a second filter installed in the second individual supply flow path. In the liquid ejecting head, regarding flow path resistance in the first individual supply flow path, flow path resistance in the first filter is the largest, regarding flow path resistance in the second individual supply flow path, flow path resistance in the second filter is the largest, and the flow path resistance in the first filter and the flow path resistance in the second filter are the same.

DESCRIPTION OF EXEMPLARY EMBODIMENTS

First Exemplary Embodiment

Figure 1:
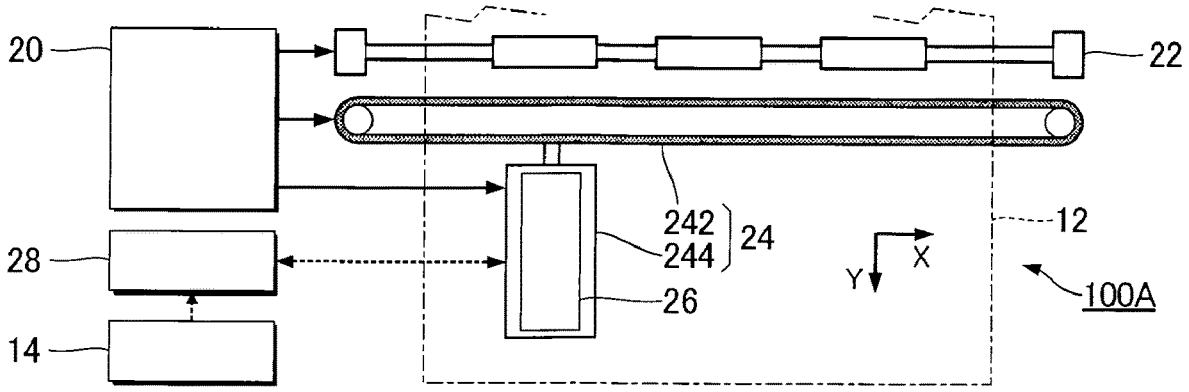
FIG. 1 is a block diagram illustrating, as an example, a configuration of a liquid ejecting apparatus according to a first exemplary embodiment.

FIG. 1 is a block diagram illustrating an example of a liquid ejecting apparatus 100A according to a first exemplary embodiment. The liquid ejecting apparatus 100A of the first exemplary embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100A. For example, a cartridge configured to detach from the liquid ejecting apparatus 100A, a bag-shaped ink pack formed of flexible film, or an ink tank into which ink can be refilled is used as the liquid container 14.

As illustrated as an example in FIG. 1, the liquid ejecting apparatus 100A includes a control unit 20, a transport mechanism 22, a moving mechanism 24, a liquid ejecting head 26, and a flow path mechanism 28. The control unit 20 includes a processing circuit such as a central processing unit (CPU) or a field programmable gate array (FPGA) and a memory circuit such as a semiconductor memory, and controls each element of the liquid ejecting apparatus 100A in an integrated manner. The control unit 20 is an example of a "controller". The transport mechanism 22 transports the medium 12 in a Y direction under the control of the control unit 20.

The moving mechanism 24 reciprocates the liquid ejecting head 26 in an X direction under the control of the control unit 20. The X direction intersects the Y direction in which the medium 12 is transported. For example, the X direction and the Y direction are orthogonal to each other. The moving mechanism 24 of the first exemplary embodiment includes a substantially box-shaped transport body 242 that houses the liquid ejecting head 26, and a transport belt 244 to which the transport body 242 is fixed. Note that a configuration in which a plurality of liquid ejecting heads 26 are mounted in the transport body 242 or a configuration in which the liquid container 14 or the flow path mechanism 28 is mounted in the transport body 242 together with the liquid ejecting head 26 can be adopted.

Under the control of the control unit 20, the liquid ejecting head 26 ejects ink, which is supplied from the liquid container 14, onto the medium 12 through a plurality of nozzles. Concurrently with the transportation of the medium 12 performed with the transport mechanism 22 and the repetitive reciprocation of the transport body 242, the liquid ejecting head 26 ejects ink onto the medium 12 to form an image on a surface of the medium 12. The flow path mechanism 28 is a mechanism that supplies ink to the liquid ejecting head 26 and that stores the ink discharged from the liquid ejecting head 26.

Figure 2:
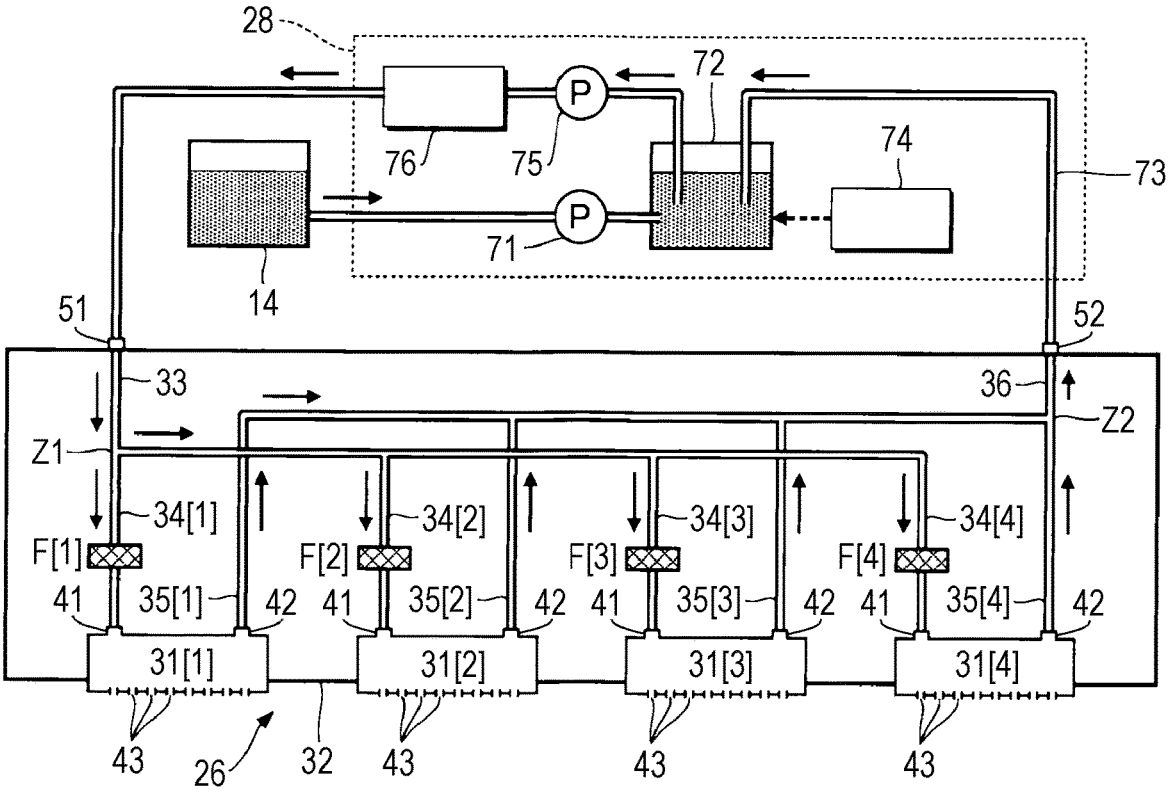
FIG. 2 is a schematic diagram illustrating, as an example, a configuration of a liquid ejecting head and a flow path mechanism.

FIG. 2 is a schematic diagram illustrating an example of a specific configuration of the liquid ejecting head 26 and the flow path mechanism 28. As illustrated as an example in FIG. 2, the liquid ejecting head 26 includes four liquid ejecting portions 31[1] to 31[4] and a support structure 32 that supports each liquid ejecting portion 31[*m*] (m=1-4). Note that the number of liquid ejecting portions 31[*m*] mounted in the liquid ejecting head 26 is optional.

Each liquid ejecting portion 31[*m*] ejects ink under the control of the control unit 20. A supply port 41, a discharge port 42, and a plurality of nozzles 43 are formed in the liquid ejecting portion 31[*m*] of the first exemplary embodiment. Ink is supplied into the liquid ejecting portion 31[*m*] through the supply port 41. In the ink supplied to the liquid ejecting portion 31[*m*] through the supply port 41, the ink that is not ejected through the nozzles 43 is discharged through the discharge port 42.

Figure 3:
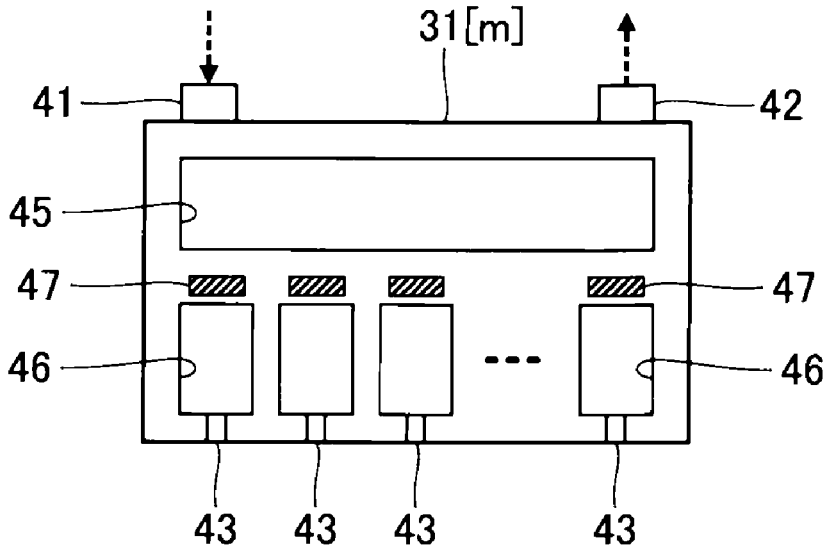
FIG. 3 is a schematic diagram illustrating, as an example, a configuration of a liquid ejecting portion.

FIG. 3 is a schematic diagram illustrating an example configuration of the liquid ejecting portion 31[*m*]. As illustrated as an example in FIG. 3, a common liquid chamber 45, a plurality of pressure chambers 46, and a plurality of drive elements 47 are provided in the liquid ejecting portion 31[*m*]. The common liquid chamber 45 is a space that is common across the plurality of nozzles 43. Ink flowing in through the supply port 41 is stored in the common liquid chamber 45.

The pressure chamber 46 and the drive element 47 are formed for each nozzle 43. Each pressure chamber 46 is a space in communication with the corresponding nozzle 43. The ink supplied from the common liquid chamber 45 is filled in each of the plurality of pressure chambers 46. Each drive element 47 changes a pressure inside the corresponding pressure chamber 46. A piezoelectric element that changes the volume of the pressure chamber 46 by deforming a wall surface of the pressure chamber 46, or a heating element that generates an air bubble inside the pressure chamber 46 by heating the ink inside the pressure chamber 46 may be suitably used as the drive element 47. The ink inside the pressure chamber 46 is ejected through the nozzle 43 by having the drive element 47 change the pressure inside the pressure chamber 46.

As illustrated as an example in FIG. 2, a supply port 51 and a discharge port 52 are formed in the support structure 32 of the liquid ejecting head 26. The ink is supplied to the supply port 51 from the flow path mechanism 28, and the ink is discharged to the flow path mechanism 28 through the discharge port 52.

A common supply flow path 33, four individual supply flow paths 34[1] to 34[4], four individual discharge flow paths 35[1] to 35[4], and a common discharge flow path 36 are formed in the support structure 32 of the liquid ejecting head 26. The common supply flow path 33 and the common discharge flow path 36 are flow paths common to the four liquid ejecting portions 31[1] to 31[4]. The individual supply flow path 34[*m*] and the individual discharge flow path 35[*m*] are flow paths formed individually for each liquid ejecting portion 31[*m*]. The common supply flow path 33 and the four individual supply flow paths 34[1] to 34[4] are flow paths that parallelly supply the ink, which is supplied from the flow path mechanism 28 to the supply port 51, to the supply ports 41 of the four liquid ejecting portions 31[1] to 31[4]. The four individual discharge flow paths 35[1] to 35[4] and the common discharge flow path 36 are flow paths that supply the ink, which is discharged through the discharge ports 42 of the four liquid ejecting portions 31[1] to 31[4], to the discharge port 52.

The common supply flow path 33 is a flow path in communication with the supply port 51. The individual supply flow path 34[*m*] is a flow path that communicates the common supply flow path 33 and the liquid ejecting portion 31[*m*] to each other. Specifically, a first end of the individual supply flow path 34[*m*] is coupled to an end portion of the common supply flow path 33 on a side opposite the supply port 51, and a second end of the individual supply flow path 34[*m*] is coupled to the supply port 41 of the liquid ejecting portion 31[*m*]. As understood from the above description, the flow paths that supply the ink from the supply port 51 to the liquid ejecting portions 31[*m*] are branched from the common supply flow path 33 into a plurality of individual supply flow paths 34[*m*] at a branching point Z1 in FIG. 2. In other words, the ink supplied from the flow path mechanism 28 to the supply port 51 is distributed to the four liquid ejecting portions 31[1] to 31[4]. The individual supply flow path 34[*m*] is a flow path from the branching point Z1 to the supply port 41 of the liquid ejecting portion 31[*m*].

A filter F[m] is installed in each individual supply flow path 34[*m*]. Specifically, the filter F[m] is installed inside a space formed midway of the individual supply flow path 34[*m*]. On the other hand, a filter is not installed in the common supply flow path 33. The filter F[m] of the individual supply flow path 34[*m*] captures air bubbles or foreign matters that are mixed in the ink that passes through the individual supply flow path 34[*m*]. Flow path resistance of each filter F[m] is the same across the four filters F[1] to F[4]. For example, the four filters F[1] to F[4] are filters of a common type and the characteristics, such as the flow path resistance, are common across the four filters F[1] to F[4].

As the flow path resistance of the filter F[m] becomes larger, the pressure loss of the ink while passing through the filter F[m] becomes larger. The pressure loss of the ink while passing through each of the four filters F[1] to F[4] is the same in the four filters F[1] to F[4] of the first exemplary embodiment. Note that in the following description, the magnitude correlation between the flow path resistance of the filters F[m] corresponds to the magnitude correlation between the pressure losses of the ink while passing through the filters F[m]. A description such as, for example, the pressure loss in the filter F[3] being larger than the pressure loss in the filter F[1] means that the flow path resistance of the filter F[3] is larger than the flow path resistance of the filter F[1].

The pressure loss in the filter F[m] is the largest among the pressure losses in the individual supply flow path 34[*m*]. In other words, the portion in the flow path from the branching point Z1 to the supply port 41 of the liquid ejecting portion 31[*m*] where the pressure loss is the largest is the filter F[m]. Nothing other than the common supply flow path 33 and the liquid ejecting portion 31[*m*] is in communication with the individual supply flow path 34[*m*]. Accordingly, the filter F[m] becomes a rate controlling member that determines the flow rate of the ink passing through the individual supply flow path 34[*m*].

For the sake of convenience, two liquid ejecting portions that are installed in the liquid ejecting head 26, namely, a liquid ejecting portion 31[*m*1] and a liquid ejecting portion 31[*m*2] (m1, m2=1-4, m1≠m2) will be focused on. The liquid ejecting portion 31[*m*1] is an example of a "first liquid ejecting portion" and the liquid ejecting portion 31[*m*2] is an example of a "second liquid ejecting portion". An individual supply flow path 34[*m*1] is an example of a "first individual supply flow path" that communicates the common supply flow path 33 and the liquid ejecting portion 31[*m*1] to each other, and an individual supply flow path 34[*m*2] is an example of a "second individual supply flow path" that communicates the common supply flow path 33 and the liquid ejecting portion 31[*m*2] to each other. Furthermore, a filter F[m1] installed in the individual supply flow path 34[*m*1] is an example of a "first filter", and a filter F[m2] installed in the individual supply flow path 34[*m*2] is an example of a "second filter". In the above configuration, the pressure loss in the filter F[m1] is the largest among the pressure losses in the individual supply flow path 34[*m*1], and the pressure loss in the filter F[m2] is the largest among the pressure losses in the individual supply flow path 34[*m*2]. In other words, in the individual supply flow path 34[*m*1], the flow path resistance in the filter F[m1] is the largest, and in the individual supply flow path 34[*m*2], the flow path resistance in the filter F[m2] is the largest. Furthermore, the pressure loss in the filter F[m1] and the pressure loss in the filter F[m2] are the same.

The common discharge flow path 36 in FIG. 2 is a flow path in communication with the discharge port 52. The individual discharge flow path 35[*m*] is a flow path that communicates the common discharge flow path 36 and the liquid ejecting portion 31[*m*] to each other. Specifically, a first end of the individual discharge flow path 35[*m*] is coupled to an end portion of the common discharge flow path 36 on a side opposite the discharge port 52, and a second end of the individual discharge flow path 35[*m*] is coupled to the discharge port 42 of the liquid ejecting portion 31[*m*]. As understood from the above description, the ink that is discharged from the discharge ports 42 of the four liquid ejecting portions 31[1] to 31[4] to the individual discharge flow paths 35[1] to 35[4] merges at a merging point Z2 in FIG. 2, passes through the common discharge flow path 36, and is supplied to the discharge port 52. As described above, while the filter F[m] is installed in the individual supply flow path 34[*m*], a filter is not installed in the individual discharge flow path 35[*m*] and the common discharge flow path 36.

Note that as illustrated as an example above, when focusing on the two liquid ejecting portions, namely, the liquid ejecting portion 31[*m*1] and the liquid ejecting portion 31[*m*2], an individual discharge flow path 35[*m*1] is an example of a "first individual discharge flow path", and an individual discharge flow path 35[*m*2] is an example of a "second individual discharge flow path".

As illustrated as an example in FIG. 2, the flow path mechanism 28 includes a first pump 71, a liquid reservoir 72, a discharge flow path 73, a negative pressure controller 74, a second pump 75, and a temperature adjusting unit 76. The first pump 71 is a pump that supplies the ink stored in the liquid container 14 to the liquid reservoir 72.

The liquid reservoir 72 is a container that stores the ink supplied from the liquid container 14. The discharge flow path 73 is a flow path that communicates the discharge port 52 of the liquid ejecting head 26 and the liquid reservoir 72 to each other. Not only the ink stored in the liquid container 14 is supplied to the liquid reservoir 72 through the first pump 71, the ink discharged through the discharge port 52 of the liquid ejecting head 26 is supplied thereto through the discharge flow path 73.

The negative pressure controller 74 is a mechanism that adjusts the pressure of the ink inside the individual discharge flow path 35[*m*] and the common discharge flow path 36 to a predetermined negative pressure. For example, an elevating mechanism that adjusts the pressure of the ink inside the individual discharge flow path 35[*m*] and the common discharge flow path 36 by moving the liquid reservoir 72 in a vertical direction to adjust the hydraulic head is suitably used as the negative pressure controller 74. Note that the configuration of the negative pressure controller 74 is optional and is not limited to the elevating mechanism. Various known control mechanisms can be adopted as the negative pressure controller 74.

The second pump 75 makes the ink stored in the liquid reservoir 72 flow. Specifically, a constant flow rate pump that makes the ink flow at a constant flow rate is used as the second pump 75. The temperature adjusting unit 76 includes, for example, a heat generating mechanism and adjusts the temperature of the ink supplied from the second pump 75. The ink, the temperature of which has been adjusted with the temperature adjusting unit 76, is supplied to the supply port 51 of the liquid ejecting head 26. Note that the temperature adjusting unit 76 may be omitted. In a configuration in which the temperature adjusting unit 76 is omitted, the ink that flows out from the second pump 75 is supplied to the supply port 51 of the liquid ejecting head 26.

As understood from the above description, the ink that has been sent from the flow path mechanism 28 to the supply port 51 circulates through the following path: the common supply flow path 33→the individual supply flow path 34[*m*]→the supply port 41→the liquid ejecting portion 31[*m*]→the discharge port 42→the individual discharge flow path 35[*m*]→the common discharge flow path 36→the discharge flow path 73→the liquid reservoir 72→the second pump 75→the temperature adjusting unit 76→the supply port 51. In other words, the ink circulates between the liquid reservoir 72 and the liquid ejecting portion 31[*m*] through the common supply flow path 33, the individual supply flow path 34[*m*], the individual discharge flow path 35[*m*], and the common discharge flow path 36.

An operation (hereinafter, referred to as a "circulation operation") that circulates the ink as in the example illustrated above is performed continuously and in parallel with an operation (hereinafter, referred to as an "ejection operation") in which the liquid ejecting head 26 ejects ink under the control of the control unit 20. Furthermore, an operation (hereinafter, referred to as an "initial filling") of initially filling the ink in each liquid ejecting portion 31[*m*] of the liquid ejecting head 26 is achieved as well with the circulation operation described above.

As described above, in the first exemplary embodiment, since the filter F[m] is installed in the individual supply flow path 34[*m*] of each liquid ejecting portion 31[*m*], when compared with a configuration in which the filter is installed in the common supply flow path 33, there is an advantage in that each filter F[m] can be made smaller. Furthermore, since the pressure loss in the filter F[m] is the largest among the pressure losses in the individual supply flow path 34[*m*], the flow rate of the ink in the individual supply flow path 34[*m*] is determined by the filter F[m] serving as the rate controlling member. Furthermore, the pressure losses in the filters F[m] are the same. Accordingly, a difference in the amount of ink supplied to each liquid ejecting portion 31[*m*] can be reduced.

Figure 4:
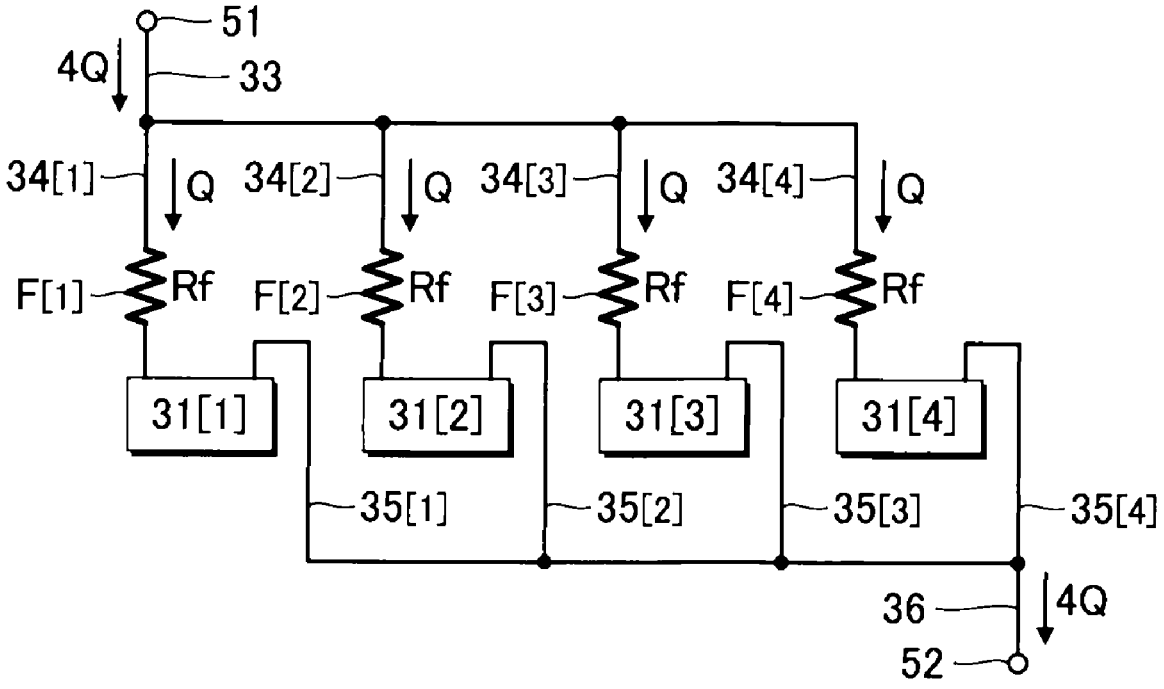
FIG. 4 is a circuit diagram equivalently illustrating flows of ink inside the liquid ejecting head.

FIG. 4 is a circuit diagram equivalently illustrating the flows of the ink inside the liquid ejecting head 26. From the viewpoint of facilitating understanding of the exemplary embodiment, each element of the liquid ejecting head 26 will be replaced, for convenience sake, with a configuration of an electric circuit in the following description. As described above, flow path resistance Rf of each of the four filters F[1] to F[4] is the same. Ink having a constant flow rate 4Q is supplied to the supply port 51 of the liquid ejecting head 26 from the flow path mechanism 28 including the second pump 75, which is a constant flow rate pump. Ink having a flow rate Q, which is the flow rate of the ink supplied to the supply port 41 divided in an equal manner, is supplied to each individual supply flow path 34[*m*]. The ink having a flow rate Q and that has been discharged from each liquid ejecting portion 31[*m*] is merged in the common discharge flow path 36 and, as a result, the ink having a flow rate 4Q is supplied to the discharge port 52.

Due to various causes, the filter F[m] may be in a state in which the ink cannot pass therethrough, or a state in which it is extremely difficult for the ink to pass therethrough. For example, in the course of initially filling the ink into the liquid ejecting head 26, air bubbles may be mixed into the ink an air bubbles may become attached to the surface of the filter F[m]. The flow of the ink through the filter F[m] is inhibited by the air bubbles attached to the filter F[m] as described above especially when the pressure of the ink is small. Furthermore, there are also cases in which a film of ink that blocks the pores of the filter F[m] is formed. In the above state, when the pressure of the ink is smaller than the surface tension of the film of ink, the flow of the ink cannot break through the film and the flow of the ink is inhibited in a similar manner to that when air bubbles are attached to the filter. In other words, the filter F[m] has a property of not substantially allowing the ink to pass therethrough when the pressure of the ink is smaller than a predetermined threshold value and allowing the ink to pass therethrough when the pressure is larger than the threshold value. The threshold value of the pressure described above is also referred to as a "bubble point". Note that in the following description, for the sake of simplicity, a wording such as the ink "not passing through" the filter F[m] will be used. "Not passing through" includes a state in which the ink does not totally pass through the filter F[m] and also a state in which the ink does not substantially pass through the filter F[m]. A state in which the ink does not substantially pass through the filter F[m] refers to a state in which, while not totally disallowing the ink to pass through the filter F[m], the passage of ink is extremely difficult. As understood from the above description, it is regarded that a condition in which the ink does "not pass through" the filter F[m] is satisfied when the pressure of the ink is smaller than the bubble point.

Figure 5:
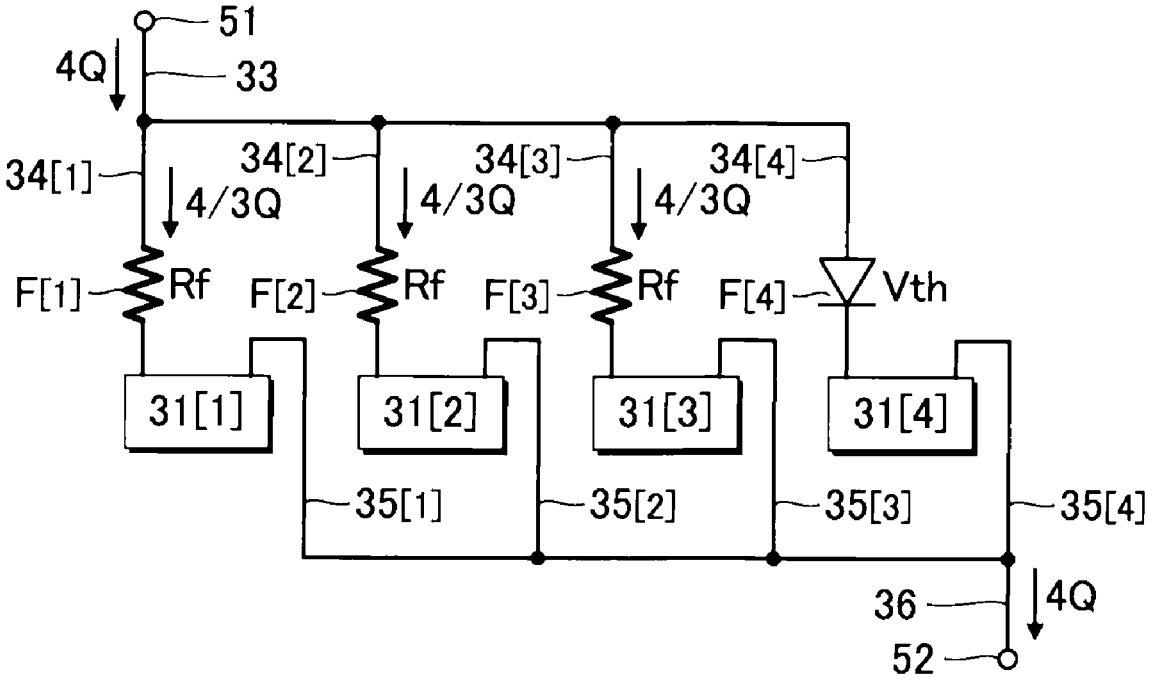
FIG. 5 is a circuit diagram equivalently illustrating an initial filling state.

FIG. 5 is a circuit diagram equivalently illustrating an initial filling state in which the ink is initially filled into the four liquid ejecting portions 31[1] to 31[4] of the liquid ejecting head 26. FIG. 5 assumes that the flow path resistance of the filter F[4] has increased. The filter F[4] in the above state is equivalently expressed as a diode that allows a current to pass therethrough when a voltage that exceeds a predetermined threshold value Vth[4] and that flows in a forward direction is applied, and that blocks the current when the voltage across the two ends is under the threshold value Vth[4]. The threshold value Vth[4] is equivalent to the bubble point. Ink is supplied to each of the three filters F[1] to F[3] at a flow rate 4Q/3 that is one third of the flow rate 4Q supplied from the second pump 75.

In the state illustrated as an example in FIG. 5, as expressed by expression (1a) below, when the pressure loss (Rf×4Q/3) in each of the three filters F[1] to F[3] is lower than the threshold value Vth[4] of the filter F[4], the ink supplied to the liquid ejecting head 26 from the flow path mechanism 28 passes through all of the three filters F[1] to F[3] and does not pass through the filter F[4] in which the flow path resistance has increased. In other words, the ink is not filled into the liquid ejecting portion 31[4].

$$Vth[4] > Rf \times 4Q/3 \tag{1a}$$

Conversely, as expressed by expression (1b) below, when the pressure loss (Rf×4Q/3) in the three filters F[1] to F[3] is higher than the threshold value Vth[4] of the filter F[4], the ink supplied to the liquid ejecting head 26 from the flow path mechanism 28 passes through all of the filters F[1] to F[4] including the filter F[4] in which the flow path resistance has increased. In other words, the ink is appropriately filled into the four liquid ejecting portions 31[1] to 31[4].

$$Vth[4] < Rf \times 4Q/3 \tag{1b}$$

As described above as an example, each filter F[m] does not allow the ink supplied at a pressure that is lower than the predetermined threshold value Vth[m] to pass therethrough and allows the ink supplied at a pressure that is higher than the threshold value Vth[m] to pass therethrough. Accordingly, the flow rate of the ink supplied from the flow path mechanism 28 to the liquid ejecting head 26 is set so that the pressure upstream of each filter F[m] is higher than the threshold value Vth[m]. With the above configuration, the ink can be appropriately supplied to the four liquid ejecting portions 31[1] to 31[4].

As in the example described above, the two liquid ejecting portions 31[*m*1] and 31[*m*2] will be focused on. The filter F[m1] does not allow the ink supplied at a pressure that is lower than a first pressure Vth[m1] to pass therethrough and allows the ink supplied at a pressure that is higher than the first pressure Vth[m1] to pass therethrough. On the other hand, the filter F[m2] does not allow the ink supplied at a pressure that is lower than a second pressure Vth[m2] to pass therethrough and allows the ink supplied at a pressure that is higher than the second pressure Vth[m2] to pass therethrough. Assuming the above state, a configuration in which the pressure in the filter F[m1] is higher than the first pressure Vth[m1] and the pressure in the filter F[m2] is higher than the second pressure Vth[m2] when the ink is supplied from the common supply flow path 33 to the individual supply flow path 34[*m*1] and the individual supply flow path 34[*m*2] is desirable. With the above configuration, the ink can be appropriately supplied to both the liquid ejecting portion 31[*m*1] and the liquid ejecting portion 31[*m*2] during the initial filling.

Second Exemplary Embodiment

A description of a second exemplary embodiment will be given. In the following examples, elements having functions similar to those of the first exemplary embodiment will be denoted by applying the reference numerals used in the description of the first exemplary embodiment, and detailed description of the elements will be omitted appropriately.

A case in which the flow path mechanism 28 supplies the ink to the liquid ejecting head 26 at a uniform flow rate has been described as an example in the first exemplary embodiment. A flow path mechanism 28 of a second exemplary embodiment supplies ink having a uniform pressure to the liquid ejecting head 26. In other words, the flow rate of the ink supplied from the flow path mechanism 28 to the liquid ejecting head 26 can be changed in the second exemplary embodiment.

Figure 6:
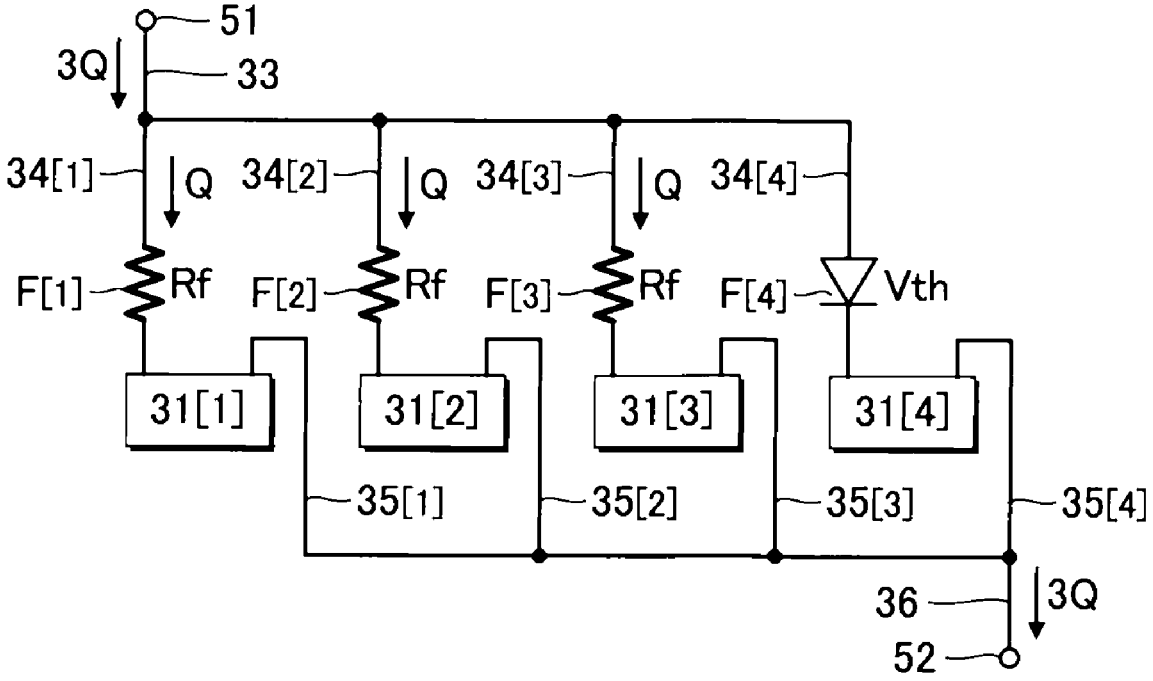
FIG. 6 is a circuit diagram equivalently illustrating an initial filling state according to a second exemplary embodiment.

FIG. 6 is a circuit diagram equivalently illustrating the flows of the ink inside the liquid ejecting head 26 during the initial filling. Similar to FIG. 5 described above, FIG. 6 assumes that the flow path resistance of the filter F[4] has increased. The ink is supplied to the three filters F[1] to F[3] at the flow rate Q.

In the state illustrated as an example in FIG. 6, as expressed by expression (2a) below, when the pressure loss (Rf×Q) in each of the three filters F[1] to F[3] is lower than the threshold value Vth[4] of the filter F[4], the ink supplied to the liquid ejecting head 26 from the flow path mechanism 28 passes through the three filters F[1] to F[3] and does not pass through the filter F[4] in which the flow path resistance has increased. In other words, the ink is not filled into the liquid ejecting portion 31[4].

$$Vth[4]>Rf\times Q \tag{2a}$$

Conversely, as expressed by expression (2b) below, when the pressure loss (Rf×Q) in each of the three filters F[1] to F[3] is higher than the threshold value Vth[4] of the filter F[4], the ink supplied to the liquid ejecting head 26 from the flow path mechanism 28 passes through all of the filters F[1] to F[4] including the filter F[4] in which the flow path resistance has increased. In other words, the ink is appropriately filled into the four liquid ejecting portions 31[1] to 31[4].

$$Vth[4]<Rf\times Q \tag{2b}$$

In the second exemplary embodiment as well, the flow rate of the ink supplied from the flow path mechanism 28 to the liquid ejecting head 26 is set so that the pressure upstream each filter F[m] is higher than the threshold value Vth[m]. Accordingly, similar to the first exemplary embodiment, the second exemplary embodiment is also capable of appropriately supplying the ink to the four liquid ejecting portions 31[1] to 31[4].

Third Exemplary Embodiment

A configuration in which the liquid ejecting apparatus 100A performs the circulation operation has been described as an example in the first and second exemplary embodiments; however, the liquid ejecting head 26 illustrated as an example in the first or second exemplary embodiment can be used in a liquid ejecting apparatus that does not perform a circulation operation. A third exemplary embodiment is a configuration in which the liquid ejecting head 26 is adopted in a liquid ejecting apparatus that does not perform a circulation operation.

Figure 7:
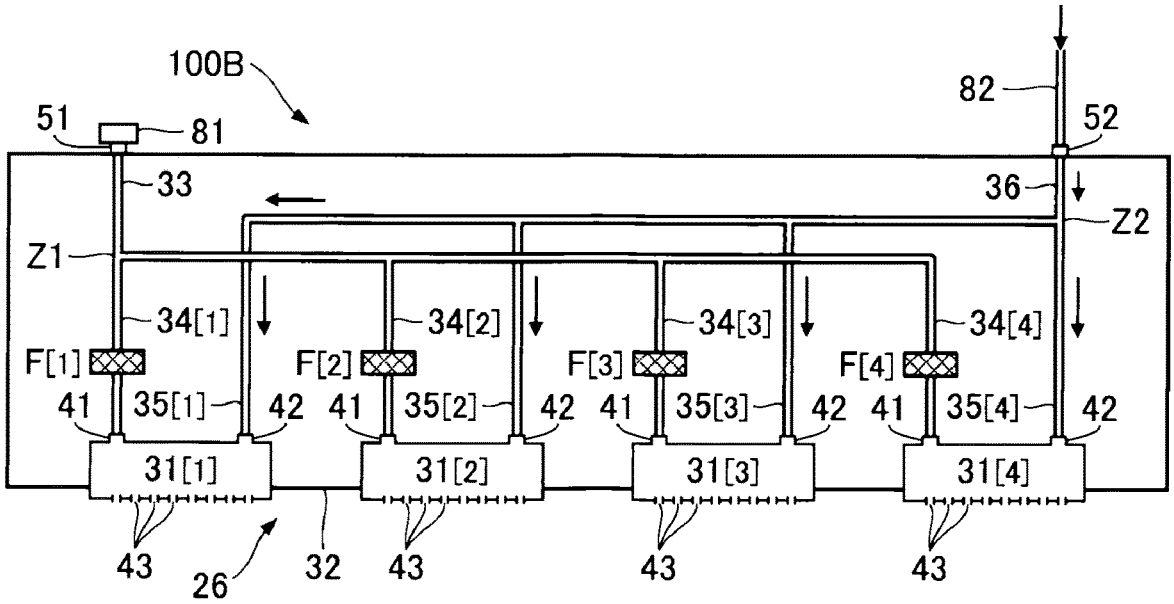
FIG. 7 is a schematic diagram illustrating, as an example, a configuration of a liquid ejecting apparatus according to a third exemplary embodiment.

FIG. 7 is a schematic diagram illustrating a configuration of a liquid ejecting apparatus 100B according to the third exemplary embodiment. As illustrated as an example in FIG. 7, the liquid ejecting head 26 mounted in the liquid ejecting apparatus 100B of the third exemplary embodiment has a configuration similar to that of the first or second exemplary embodiment.

In the liquid ejecting head 26, the pressure loss in each filter F[m] is relatively large. Accordingly, when the circulation operation is not performed in a configuration in which the liquid ejecting portion 31[*m*] ejects the ink supplied to the supply port 51, the amount of ink ejected from each nozzle 43 may become insufficient due to the pressure loss in the filter F[m]. In consideration of the above situation, in the third exemplary embodiment, the ink is supplied to the liquid ejecting portion 31[*m*] through the discharge port 52 of the liquid ejecting head 26 during both the initial filling and the ejection operation.

As illustrated as an example in FIG. 7, the supply port 51 of the liquid ejecting head 26 is closed with a closing member 81. The ink inside the liquid container 14 is supplied to the discharge port 52 through a supply flow path 82. The ink supplied to the discharge port 52 is supplied to the liquid ejecting portion 31[*m*] through the common discharge flow path 36 and the individual discharge flow path 35[*m*]. The ejection operation in which the liquid ejecting portion 31[*m*] ejects ink is similar to that of the first exemplary embodiment or the second exemplary embodiment.

The third exemplary embodiment enables the liquid ejecting head 26 of the first or second exemplary embodiment to be used in the liquid ejecting apparatus 100B that does not perform a circulation operation. Furthermore, since the ink is supplied to the liquid ejecting portion 31[*m*] through the discharge port 52 of the liquid ejecting head 26, sufficient amount of ink can be supplied to the liquid ejecting portion 31[*m*] without being affected by the pressure loss in the filter F[m]. Accordingly, a possibility of a lack in the amount of ink ejected from the liquid ejecting portion 31[*m*] can be reduced.

Fourth Exemplary Embodiment

Figure 8:
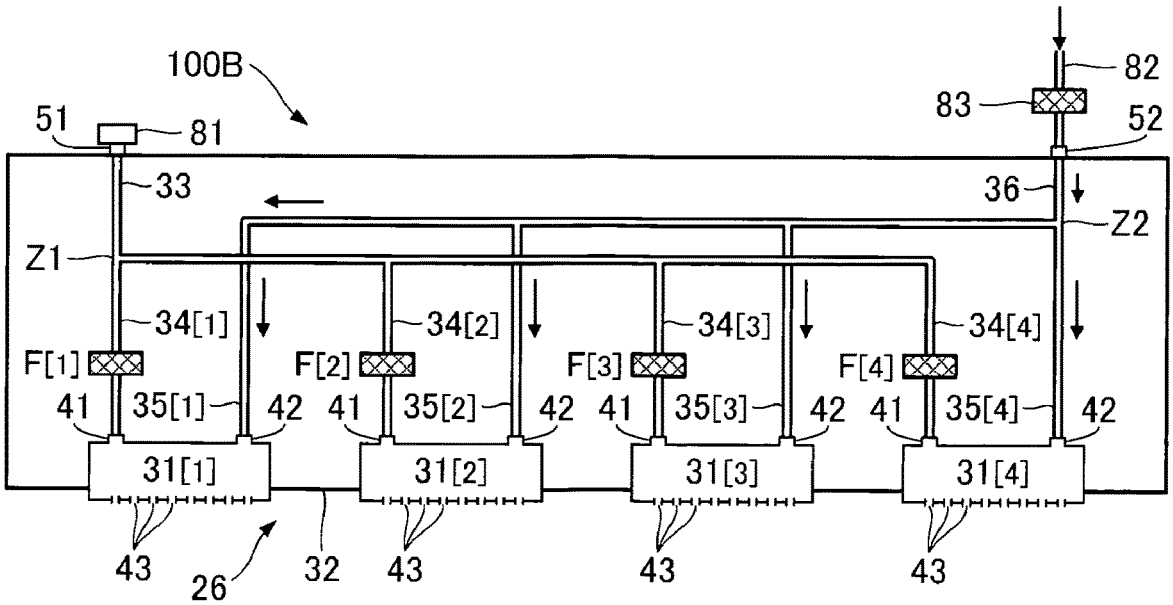
FIG. 8 is a schematic diagram illustrating, as an example, a configuration of a liquid ejecting apparatus according to a fourth exemplary embodiment.

FIG. 8 is a schematic diagram illustrating a configuration of a liquid ejecting apparatus 100B according to a fourth exemplary embodiment. Similar to the third exemplary embodiment, in the fourth exemplary embodiment, the ink inside the liquid container 14 is supplied to the liquid ejecting portion 31[*m*] through the discharge port 52 of the liquid ejecting head 26. The supply port 51 is closed by the closing member 81 and the circulation operation is not performed. Accordingly, an effect similar to that of the third exemplary embodiment can be provided in the fourth exemplary embodiment as well.

As illustrated as an example in FIG. 8, a filter 83 is installed in the supply flow path 82 that supplies ink to the discharge port 52. In other words, the filter 83 is externally attached to the liquid ejecting head 26. The filter 83 captures air bubbles or foreign matters that are mixed in the ink that passes through the supply flow path 82. The filter 83 in which the degree of pressure loss does not cause the ejection amount of ink from the liquid ejecting portion 31[*m*] to be insufficient is appropriately used. As understood from the above description, the fourth exemplary embodiment has an advantage in that the air bubbles or the foreign matters in the ink supplied to the discharge port 52 of the liquid ejecting head 26 can be captured with the filter 83 during the initial filling and the ejection operation.

Note that in the first and second exemplary embodiments, an example of the liquid ejecting head 26 satisfying the following conditions has been given.

[Condition 1] The pressure loss in the filter F[m] is the largest among the pressure losses in the individual supply flow path 34[*m*].

[Condition 2] The pressure loss in each filter F[m] is the same.

[Condition 3] The pressure upstream of the filter F[m] is higher than the threshold value Vth[m].

However, the third or the fourth exemplary embodiment may use a liquid ejecting head 26 that does not satisfy at least either one of the conditions 1 to 3.

Fifth Exemplary Embodiment

Figure 9:
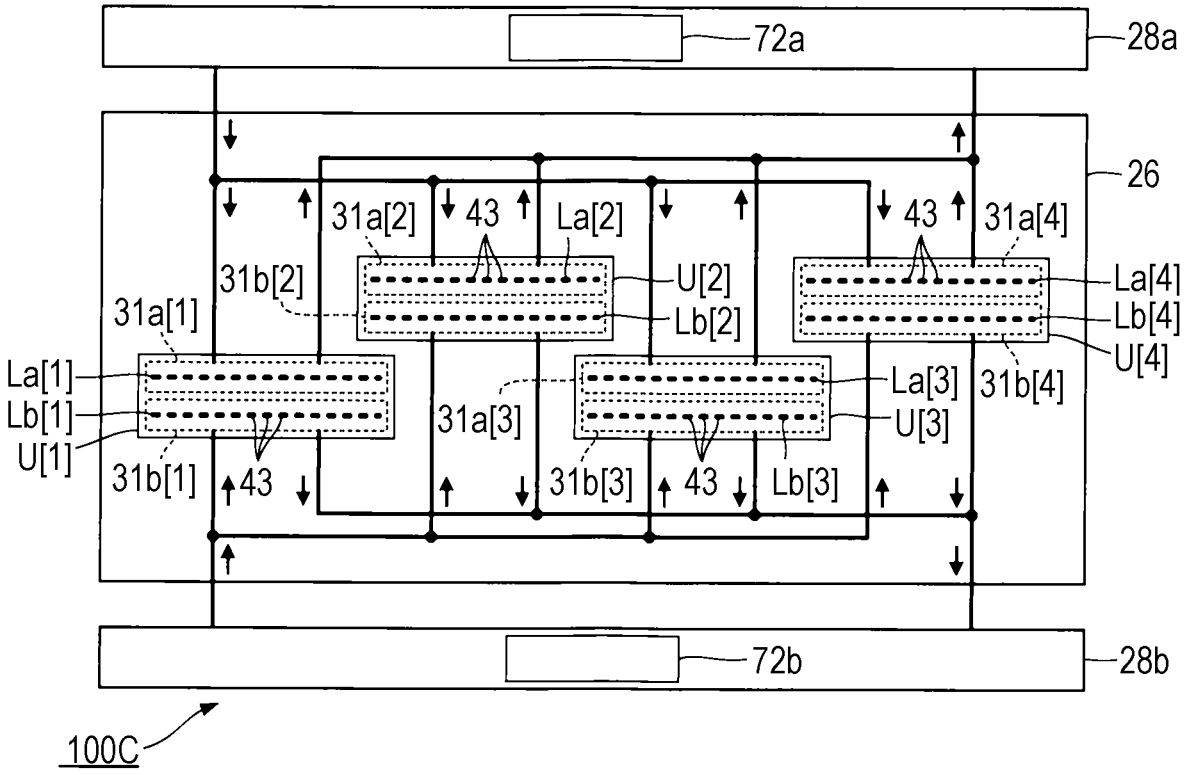
FIG. 9 is a schematic diagram illustrating, as an example, a configuration of a liquid ejecting apparatus according to a fifth exemplary embodiment.

FIG. 9 is a schematic diagram illustrating a configuration of a liquid ejecting apparatus 100C according to a fifth exemplary embodiment. As illustrated as an example in FIG. 9, the liquid ejecting apparatus 100C of the fifth exemplary embodiment includes a liquid ejecting head 26, a first flow path mechanism 28*a*, and a second flow path mechanism 28*b*.

The liquid ejecting head 26 includes four liquid ejecting units U[1] to U[4]. The liquid ejecting unit U[m] includes a liquid ejecting portion 31*a*[*m*] and a liquid ejecting portion 31*b*[*m*]. An array (hereinafter, referred to as a "first line") La[m] of a plurality of nozzles 43 is formed in the liquid ejecting portion 31*a*[*m*], and an array (hereinafter, referred to as a "second line") Lb[m] of a plurality of nozzles 43 is formed in the liquid ejecting portion 31*b*[*m*]. The first line La[m] and the second line Lb[m] are parallelly arranged with a space in between each other. The liquid ejecting portion 31*a*[*m*] ejects ink of a first color through the nozzles 43 of the first line La[m], and the liquid ejecting portion 31*b*[*m*] ejects ink of a second color through the nozzles 43 of the second line Lb[m]. The first color and the second color are different colors.

The first flow path mechanism 28*a* and the second flow path mechanism 28*b* are configured in a similar manner to that of the flow path mechanism 28 of the first exemplary embodiment. The first flow path mechanism 28*a* circulates the ink of the first color to the liquid ejecting portion 31*a*[*m*] of each of the four liquid ejecting units U[1] to U[4]. Specifically, the first flow path mechanism 28*a* supplies the ink stored in a liquid reservoir 72*a* to the liquid ejecting portion 31*a*[*m*] and stores the ink discharged from the liquid ejecting portion 31*a*[*m*] in the liquid reservoir 72*a*. Similarly, the second flow path mechanism 28*b* circulates the ink of the second color to the liquid ejecting portion 31*b*[*m*] of each of the four liquid ejecting units U[1] to U[4]. Specifically, the second flow path mechanism 28*b* supplies the ink stored in a liquid reservoir 72*b* to the liquid ejecting portion 31*b*[*m*] and stores the ink discharged from the liquid ejecting portion 31*b*[*m*] in the liquid reservoir 72*b*.

As understood from the above description, in the fifth exemplary embodiment, the flow path that circulates the ink of the first color to the four liquid ejecting portions 31*a*[1] to 31*a*[4], and the flow path that circulates the ink of the second color to the four liquid ejecting portions 31*b*[1] to 31*b*[4] are formed individually. Note that the number of liquid ejecting units U[m] is optional.

Modifications

Each of the exemplary embodiments described above as examples can be modified in various ways. Specific modification modes that can be applied to the exemplary embodiments described above will be described below as examples. Two or more optionally selected modes from the examples below can be integrated as appropriate as long as they do not contradict each other.

(1) In the first and second exemplary embodiments, the ink is supplied from the flow path mechanism 28 to the supply port 51 during both the initial filling and the ejection operation, and in the third and fourth exemplary embodiments, the ink is supplied from the supply flow path 82 to the discharge port 52 during both the initial filling and the ejection operation. However, the destinations of the ink during the initial filling and the ejection operation are not limited to the examples described above.

For example, during the initial filling, the ink may be filled in the liquid ejecting portion 31[*m*] by supplying the ink to the discharge port 52 from the supply flow path 82, and during the ejection operation, the ink may be supplied to the liquid ejecting portion 31[*m*] from the flow path mechanism 28 through the supply port 51. In other words, similar to the third and fourth exemplary embodiments, the liquid ejecting portion 31[*m*] ejects the ink that has been initially filled through the common discharge flow path 36 and the individual discharge flow path 35[*m*]. Note that in the above configuration, the ejection operation is performed in parallel with the circulation operation.

Furthermore, during the initial filling, the ink may be filled to the liquid ejecting portion 31[*m*] from the flow path mechanism 28 through the supply port 51, and during the ejection operation, the ink may be supplied to the liquid ejecting portion 31[*m*] from the supply flow path 82 through the discharge port 52. In other words, similar to the first and second exemplary embodiments, the liquid ejecting portion 31[*m*] ejects the ink that has been initially filled through the common supply flow path 33 and the individual supply flow path 34[*m*]. Note that in the above configuration, the initial filling is performed in parallel with the circulation operation.

(2) The pressure loss in the filter F[m1] and the pressure loss in the filter F[m2] being the "same" includes a case in which the pressure losses of the two completely coincide with each other and a case in which the pressure losses of the two substantially coincide with each other. The pressure losses substantially coinciding with each other is, for example, when the difference between one of the pressure losses of the filter F[m1] and the filter F[m2] and the other one of the pressure losses is within a range of ±5%.

Furthermore, the difference between the pressure losses that is within a range of the manufacturing error of the filter F[m1] and the filter F[m2] is included in the "substantially coinciding with each other".

(3) While in each exemplary embodiment described above, the serial type liquid ejecting apparatus in which the transport body 242 in which the liquid ejecting head 26 is mounted is reciprocated has been described as an example, a line type liquid ejecting apparatus in which a plurality of nozzles 43 are distributed across the entire width of the medium 12 can also be applied to the present disclosure.

(4) The liquid ejecting apparatuses described as examples in the embodiments described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a first liquid ejecting portion for ejecting a liquid;

a second liquid ejecting portion for ejecting the liquid;

a common supply flow path being supplied the liquid from a liquid reservoir;

a first individual supply flow path communicating the common supply flow path and the first liquid ejecting portion to each other;

a second individual supply flow path that communicating the common supply flow path and the second liquid ejecting portion to each other;

a first filter provided in the first individual supply flow path;

a second filter provided in the second individual supply flow path;

a common discharge flow path discharging the liquid;

a first individual discharge flow path communicating the common discharge flow path and the first liquid ejecting portion to each other;

a second individual discharge flow path communicating the common discharge flow path and the second liquid ejecting portion to each other;

a supply flow path configured to supply the liquid to the common discharge flow path;

a third filter provided in the supply flow path, wherein regarding flow path resistance in the first individual supply flow path, flow path resistance in the first filter is largest, regarding flow path resistance in the second individual supply flow path, flow path resistance in the second filter is largest, the flow path resistance in the first filter and the flow path resistance in the second filter are same, nothing other than the common supply flow path and the first liquid ejecting portion is in communication with the first individual supply flow path, nothing other than the common supply flow path and the second liquid ejecting portion is in communication with the second individual supply flow path, and a filter is not provided in the first individual discharge flow path nor in the second individual discharge flow path.

2. The liquid ejecting head according to claim 1, wherein a filter is not provided in the common supply flow path.

3. The liquid ejecting head according to claim 1, wherein the liquid circulates between the liquid reservoir and the first liquid ejecting portion through the common supply flow path, the first individual supply flow path, the first individual discharge flow path, and the common discharge flow path, and the liquid circulates between the liquid reservoir and the second liquid ejecting portion through the common supply flow path, the second individual supply flow path, the second individual discharge flow path, and the common discharge flow path.

4. The liquid ejecting head according to claim 3, wherein a filter is not provided in the first individual discharge flow path nor in the second individual discharge flow path.

5. The liquid ejecting head according to claim 1, wherein the first and second filters are of a common type of filter that are configured to act as rate controlling members such that a first filter configures not to pass the liquid supplied at a pressure that is lower than a first pressure therethrough and configures to pass the liquid supplied at a pressure that is higher than the first pressure therethrough, the second filter configures not to pass the liquid supplied at a pressure that is lower than a second pressure therethrough and configures to pass the liquid supplied at a pressure that is higher than the second pressure therethrough, and when the liquid is supplied from the common supply flow path to the first individual supply flow path and the second individual supply flow path, a pressure of the liquid supplied to the first filter is higher than the first pressure, and a pressure of the liquid supplied to the second filter is higher than the second pressure.

6. A liquid ejecting apparatus comprising:

a liquid ejecting head according to claim 1; and a controller controlling an ejection of the liquid in the liquid ejecting head.

7. A liquid ejecting head comprising:

a first liquid ejecting portion for ejecting a liquid;

a second liquid ejecting portion for ejecting the liquid;

a common supply flow path being supplied the liquid from a liquid reservoir;

a first individual supply flow path communicating the common supply flow path and the first liquid ejecting portion to each other;

a second individual supply flow path communicating the common supply flow path and the second liquid ejecting portion to each other;

a first filter provided in the first individual supply flow path; and a second filter provided in the second individual supply flow path;

a common discharge flow path discharging the liquid;

a first individual discharge flow path communicating the common discharge flow path and the first liquid ejecting portion to each other;

a second individual discharge flow path communicating the common discharge flow path and the second liquid ejecting portion to each other;

a supply flow path configured to supply the liquid to the common discharge flow path;

a third filter provided in the supply flow path, wherein among pressure losses in the first individual supply flow path, a pressure loss in the first filter is largest, among pressure losses in the second individual supply flow path, a pressure loss in the second filter is largest, the pressure loss in the first filter and the pressure loss in the second filter are same, nothing other than the common supply flow path and the first liquid ejecting portion is in communication with the first individual supply flow path, nothing other than the common supply flow path and the second liquid ejecting portion is in communication with the second individual supply flow path, and a filter is not provided in the first individual discharge flow path nor in the second individual discharge flow path.

8. The liquid ejecting apparatus according to claim 7, wherein the first liquid ejecting portion ejects the liquid filled through the common supply flow path and the first individual supply flow path, and the second liquid ejecting portion ejects the liquid filled through the common supply flow path and the second individual supply flow path.

9. The liquid ejecting apparatus according to claim 7, wherein the liquid circulates between the liquid reservoir and the first liquid ejecting portion through the common supply flow path, the first individual supply flow path, the first individual discharge flow path, and the common discharge flow path, and the liquid circulates between the liquid reservoir and the second liquid ejecting portion through the common supply flow path, the second individual supply flow path, the second individual discharge flow path, and the common discharge flow path.

10. The liquid ejecting apparatus according to claim 7, wherein the first liquid ejecting portion ejects the liquid filled through the common discharge flow path and the first individual discharge flow path, and the second liquid ejecting portion ejects the liquid filled through the common discharge flow path and the second individual discharge flow path.

11. A liquid ejecting apparatus comprising:

a liquid ejecting head according to claim 7; and a controller controlling an ejection of the liquid in the liquid ejecting head.

12. The liquid ejecting apparatus according to claim 11, wherein the liquid ejecting head includes, a common discharge flow path discharging the liquid, a first individual discharge flow path communicating the common discharge flow path and the first liquid ejecting portion to each other, and a second individual discharge flow path communicating the common discharge flow path and the second liquid ejecting portion to each other.

13. The liquid ejecting apparatus according to claim 12, wherein the liquid circulates between the liquid reservoir and the first liquid ejecting portion through the common supply flow path, the first individual supply flow path, the first individual discharge flow path, and the common discharge flow path, and the liquid circulates between the liquid reservoir and the second liquid ejecting portion through the common supply flow path, the second individual supply flow path, the second individual discharge flow path, and the common discharge flow path.

14. The liquid ejecting apparatus according to claim 12, wherein the first liquid ejecting portion ejects the liquid filled through the common supply flow path and the first individual supply flow path, and the second liquid ejecting portion ejects the liquid filled through the common supply flow path and the second individual supply flow path.

15. The liquid ejecting apparatus according to claim 12, wherein the first liquid ejecting portion ejects the liquid filled through the common discharge flow path and the first individual discharge flow path, and the second liquid ejecting portion ejects the liquid filled through the common discharge flow path and the second individual discharge flow path.

16. The liquid ejecting apparatus according to claim 7, wherein the liquid ejecting head includes a support structure that supports the first and second liquid ejecting portions and that has the first and second individual supply flow paths, the first and second individual discharge flow paths, the first and second common supply flow paths, and the first and second common discharge flow paths, and the third filter is provided outside the liquid ejecting head.

17. The liquid ejecting apparatus according to claim 16, further comprising a closing member configured to close the common supply flow path.

18. The liquid ejecting head according to claim 7, wherein the first and second filters are of a common type of filter that are configured to act as rate controlling members such that the first filter configures not to pass the liquid supplied at a pressure that is lower than a first pressure therethrough and configures to pass the liquid supplied at a pressure that is higher than the first pressure therethrough, the second filter configures not to pass the liquid supplied at a pressure that is lower than a second pressure therethrough and configures to pass the liquid supplied at a pressure that is higher than the second pressure therethrough, and when the liquid is supplied from the common supply flow path to the first individual supply flow path and the second individual supply flow path, a pressure of the liquid supplied to the first filter is higher than the first pressure, and a pressure of the liquid supplied to the second filter is higher than the second pressure.

* * * * *